United States Patent [19]

Abbott

[11] Patent Number: 5,022,149

[45] Date of Patent: Jun. 11, 1991

[54] METHOD AND APPARATUS FOR MAKING A LOOPED FIN HEAT EXCHANGER

[76] Inventor: Roy W. Abbott, 450 N. Hubbard La., Louisville, Ky. 40207

[21] Appl. No.: 563,425

[22] Filed: Aug. 7, 1990

Related U.S. Application Data

[60] Division of Ser. No. 93,860, Sep. 8, 1987, which is a continuation-in-part of Ser. No. 767,801, Aug. 21, 1985, abandoned.

[51] Int. Cl.[5] ..... B21D 53/02

[52] U.S. Cl. ..... 29/890.048; 29/890.035; 29/727; 72/70; 72/185

[58] Field of Search ..... 29/890.048, 890.035, 29/446, 428, 557, 33 D, 33 G, 727; 72/70, 129, 176, 185; 165/184

[56] References Cited

U.S. PATENT DOCUMENTS

| | | | |
|---|---|---|---|
| 3,288,209 | 11/1966 | Wall et al. | 29/890.048 |
| 3,367,161 | 2/1968 | Avakian | 72/185 |
| 3,964,286 | 6/1986 | Oerther et al. | 72/176 |
| 4,224,984 | 9/1980 | Miyata et al. | 29/890.048 |
| 4,381,592 | 5/1983 | Venables, III et al. | 29/890.048 |
| 4,542,568 | 9/1985 | Venable, III et al. | 29/890.048 |
| 4,581,800 | 4/1986 | Johnson | 29/890.048 |

FOREIGN PATENT DOCUMENTS

| | | | |
|---|---|---|---|
| 0036063 | 4/1978 | Japan | 29/890.048 |
| 0066050 | 6/1978 | Japan | 29/890.048 |

*Primary Examiner*—Howard N. Goldberg
*Assistant Examiner*—Irene Cuda
*Attorney, Agent, or Firm*—James A. Rich

[57] ABSTRACT

A heat transfer device effective in minimizing frost bridging in refrigeration operations to be wound helically onto a refrigerant-carrying tube, has an integrally formed chain of looped fins, each fin having a mounting flange at each end of the chain, and a vertical tin member extending from each mounting flange connected by a bridge portion. A method and apparatus for making the heat transfer device a unitary stretch preforming process to reform the beginning fin stock into final looped fin shape in a single forming step.

12 Claims, 11 Drawing Sheets

SECTION C-C

SECTION D-D

SECTION E-E

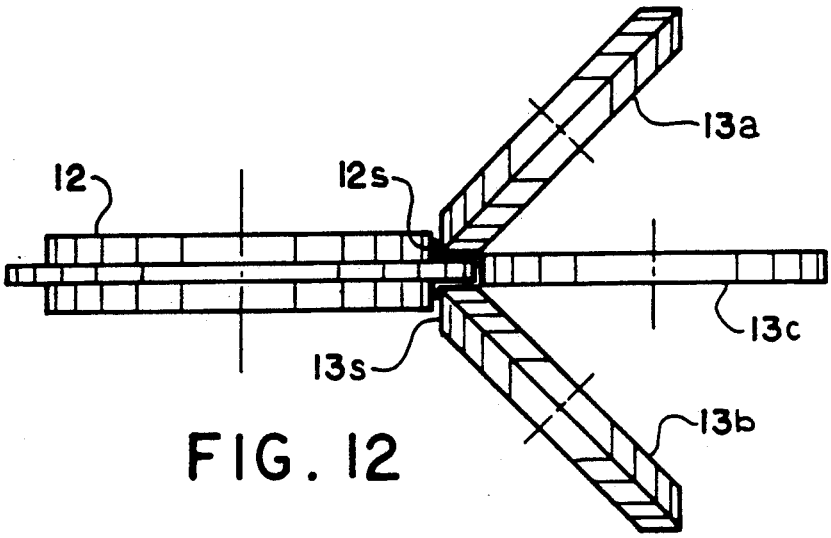
FIG. 12
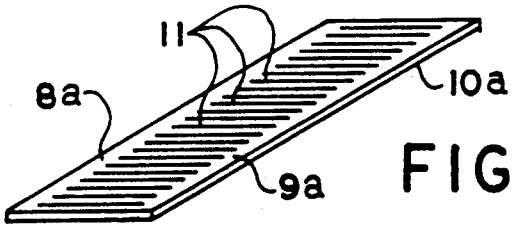
FIG. 13
FIG. 14B
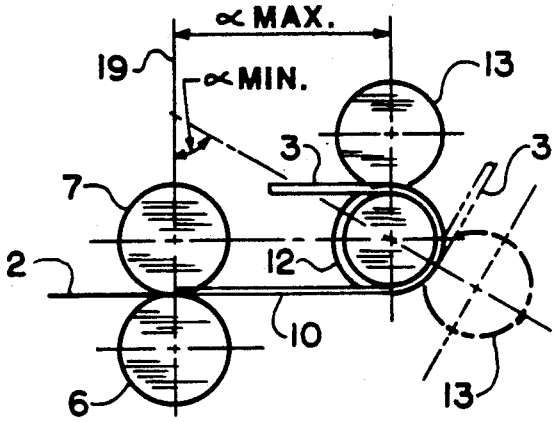
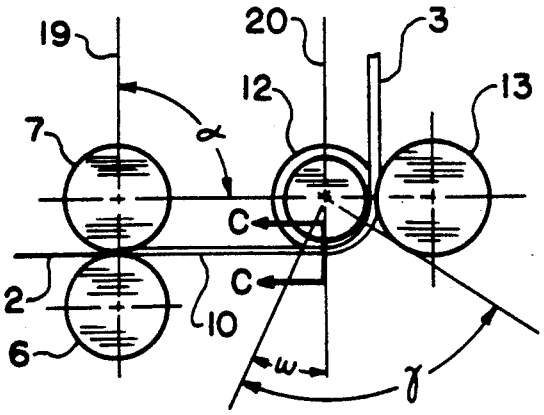
FIG. 14A

METHOD AND APPARATUS FOR MAKING A LOOPED FIN HEAT EXCHANGER

CROSS-REFERENCE TO RELATED APPLICATION

This is a division of application Ser. No. 07/093,860, filed Sept. 8, 1987, which is a continuation-in-part of my copending application Ser. No. 767,801, filed Aug. 21, 1985, now abandoned.

BACKGROUND OF THE INVENTION

The present invention relates to an improved heat transfer fin and to a process for making and applying this fin to a refrigerant carrying tube, which has particular utility in refrigerant heat transfer.

In refrigeration applications, it is common to utilize a refrigerant-carrying tube to supply the means by which heat is removed from the chamber or areas to be cooled. Ordinarily, the heat removal is accomplished by forced convection between two separated fluids. For example, in household refrigeration applications such as refrigerators, the two separated fluids would be [1] a refrigerant contained within a cooling tube and [2] air flowing across the refrigerant-carrying tube to assist in transferring heat to or from the tube wall as imparted by the heat of vaporization or condensation of the refrigerant within the tube. In the applications just mentioned, the refrigerant carrying tubes are usually provided either as a condenser or an evaporator.

In such forced convection applications, it is common practice to provide a balance between the amount of heat transfer surface area and the heat transfer coefficients at the respective surfaces. Ordinarily this balance is maintained in an inverse relation. Thus, where the particular fluid has a relatively low heat transfer coefficient, a greater amount of exposed heat transfer surface is generally provided. In addition, the practitioner seeks an economic balance between the amount and structure of the exposed heat transfer surface area considering the heat transfer coefficients of the fluids involved. As an example, in a standard refrigeration application, the refrigerant has a significantly greater ability to transfer heat to the tube in which it is carried than does the air which flows thereacross to remove the heat transferred to the tube by the refrigerant. As a result, it is an accepted practice in the refrigeration art to substantially increase the surface area provided on the outside, or air side, of the tube to balance the ability of the refrigerant to supply heat to the inside of the tube.

Most often, the increased surface area provided on the air side of the refrigerant carrying tube is provided in the form of some sort of extended cooling surface or fin extending from the tube. Many types of finned tubing are commercially available for use in refrigerant-to-air heat exchangers (both evaporators and condensers). One type of extended surface fin is the type of strip fin known as a "spine fin" as disclosed in my prior U.S. Pat. No. 2,983,300. Other types of extended surface fins are disclosed in U.S. Pat. No. No. 4,143,710 issued to LaPorte et al. These latter fins are complex geometric shapes, which are difficult to fabricate and have a higher degree of wasted material in relation to the heat transfer capacity provided. The spine fin has a disadvantage in that it is mechanically weak and has a low resistance to bending and compressive forces. Therefore, to permit practical utilization of the spine fin, in use the spine fins are spaced or bunched very closely on the refrigerant tube.

The spine fins and geometric fins have been used successfully for many years to increase the surface area on the air side of refrigerant carrying tubes in home air conditioning units (i.e., the evaporator), where the operating temperature of the air flowing across the air side of the tube is above the freezing Point of water. Heretofore, however, cooling fins similar to the spine fin and the geometric fin have not been successful in environments where the air temperatures are below freezing, primarily for two reasons: [1] because the moisture in the freezing air condenses out and forms a "frost bridge" between the closely spaced spine fins or portions of the geometric fins, which materially inhibits the air flow across and between the spine fins, which in turn reduces the heat transfer capability; and [2] if the fins are spaced far enough apart to prevent frost bridging, the resulting structure is too mechanically weak to permit practical fabrication on an industrial scale.

Mechanisms through which frost accumulates on evaporation fins are understood (cf *The Frost Formation on Parallel Plates at Very Low Temperatures in a Humid Stream* by M. C. Chuang, ASME paper 76-WA/HT-60, presented at the ASME Winter Annual Meeting, New York, N.Y., Dec. 5, 1976), and fin structures have been developed for frosting applications. Typically, these fins are plates that extend at right angles across a number of tubes. The plates are spaced relatively far apart, typically 4 or 5 fins per inch, to reduce frost bridging. Their performance is adequate, but markedly inferior to the smaller spine fins from a heat exchange standpoint. Thus, smaller fins with sufficient mechanical strength to allow them to be placed far enough apart to effectively reduce frost bridging are desireable. Of course, since the fins are intended for frosting applications such as refrigerator evaporators, the fins should also be designed to avoid or minimize frost accumulation.

OBJECTS AND SUMMARY OF THE INVENTION

The present invention utilizes a new concept which I have denominated "looped fin," which addresses and solves the dual problems of frost bridging and insufficient mechanical strength while minimizing fin cost by miniaturizing the fin structure. Accordingly, an object of the present invention is to provide a cooling fin to minimize frost bridging, which will function in an environment where the convection air forced across the looped fins is cooled below the freezing point of water, while at the same time maintaining sufficient mechanical strength to permit pragmatic utilization.

It is another object of the present invention to provide a heat transfer fin of increased heat transfer capacity which will permit the same amount of heat transfer to be accomplished with a significantly reduced amount of heat transfer materials.

It is also an object of the present invention to provide a unitary method to manufacture the looped fin and to simultaneously apply the looped fin to refrigerant-carrying tube stock, so as to minimize the number of steps required in the manufacturing/application process.

Other objects and further scope of applicability of the present invention will become apparent from the detailed description provided below. It should be understood, however, that the detailed description provided herein is illustrative only, given for the purposes of indicating how to make and use the presently preferred embodiments of the present invention, and that various modifications will be apparent to those skilled in the art which will not depart from the objects and scope of the present invention.

To achieve the above objects of the present invention, a coil of heat transfer fin stock is processed perpendicularly through intermeshing lance cutter rolls, where the cutting rolls slits through the thickness of the fin stock, the length of the slits being less than the width of the fin stock. Flanges on one of the intermeshing lance cutter rolls simultaneously form the just-lanced stock into a shallow channel form with the turned-up portions of the channel being relatively short compared to the length of the lanced web portion thereof.

The lanced-and-channelled fin stock is then fed over a male/female combination roller which forms the channelled stock into a generally U-shaped form, which converts the turned-up edge portions of the channel into base flanges substantially parallel to the bridge portion of the U. I have denominated this as "looped fin" configuration. Positioning the form rolls at an angle with respect to the lance cutters, combined with operating the form rolls at a slightly higher peripheral speed than the lance cutter rolls results in stretch preforming of the lanced fin stock as it approaches the form rolls. Stretch preforming results from the tension on the unlanced side flanges of the channel provided by the higher speed of the form rolls, and results in separation of the lanced strips in the center section of the channelled fin stock into a chain of integrally formed members, while simultaneously preforming the channel into a progressive generally U shape as the stretched channel progresses around the male form roll and then through the intermesh between the male and female form rolls. As the chain of looped fin members exits from the intermesh of the male and female form rolls it is in a form to be immediately applied to tube stock for carrying refrigerant.

The looped fin stock may then be helically wound onto refrigerant tube stock by feeding the tube stock in a direction perpendicular to the direction of travel of the looped fin stock, with the space or pitch between helical windings being determined by the rotational speed of the table carrying the fin stock and work stations which accomplish the present invention, and the linear speed of travel of the refrigerant tube stock in a vertical direction compared to the work table. Appropriate tension to permit proper helical windery is maintained during application of the looped fin stock to the refrigerant tube by adjusting the lance cutter drive to feed out approximately 1 to 3% less looped fin stock length than is required to complete one helical wrap around the tube stock. This tension assures adequate contact between the base flanges of the looped fin stock and the outer periphery of the refrigerant tube stock which promotes a good heat transfer relationship between the looped fin and the refrigerant tube.

BRIEF DESCRIPTION OF THE DRAWINGS

FIG. 3 is a cross sectional view of the looped fin of the present invention taken along the line A—A of FIG. 2.

FIG. 7 is a plan view of the combined stretch-forming and U-forming work station; FIG. 8 is a top view of the stretch-forming and U-forming work station;

FIG. 12 depicts an alternate method to form the U-form of the looped fin;

FIG. 13 is a perspective view of the flat center lanced fin stock displayed in the alternative method of making the present invention disclosed in FIG. 11.

FIG. 14A shows the preferred angular relation between the lance cutter work station and the form roll work station; FIG. 14B shows the possible range of angular relation between the lance cutter work station and the form roll work station.

DESCRIPTION OF THE PREFERRED EMBODIMENTS

Figure 1:
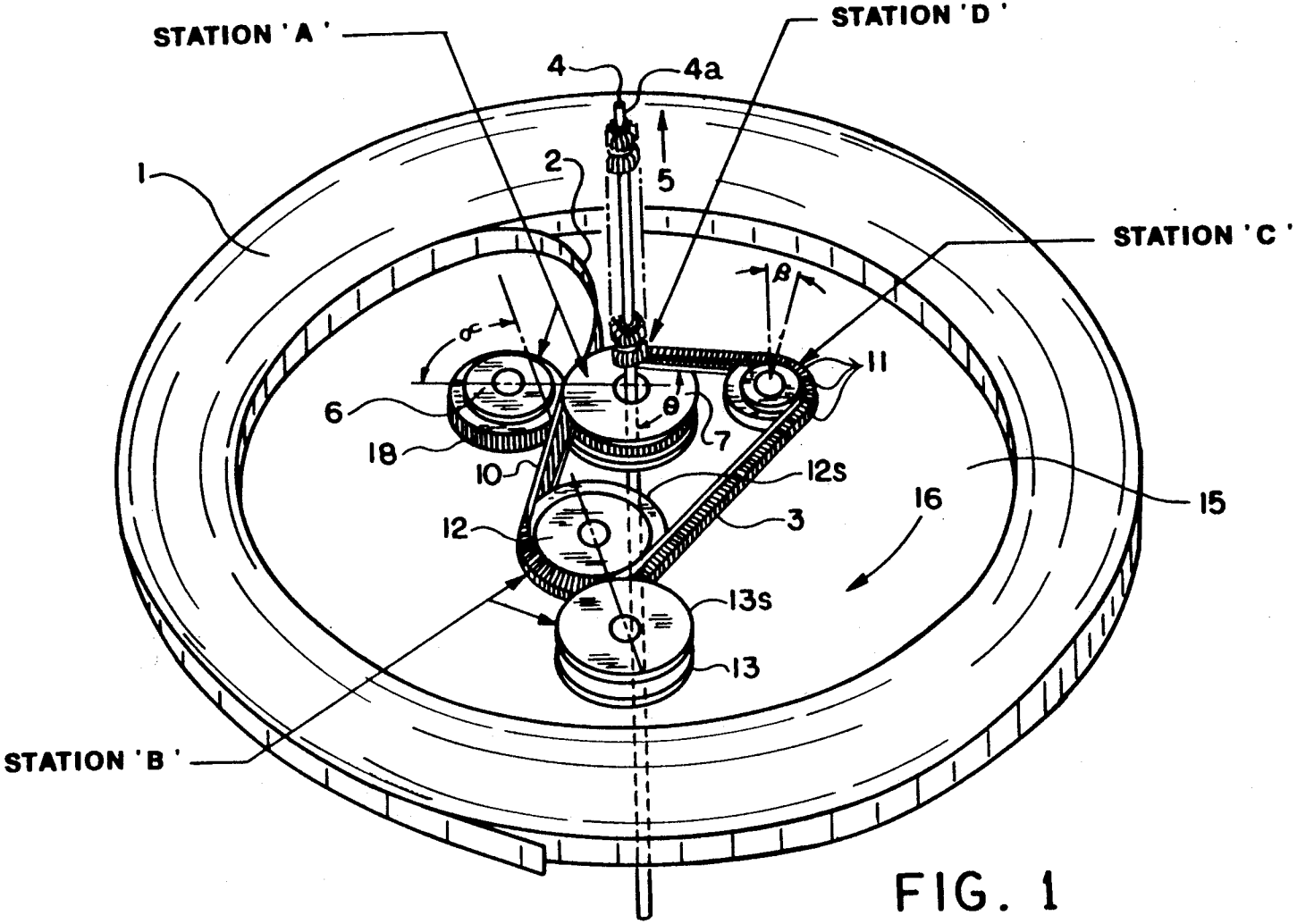
FIG. 1 is a perspective view of the presently preferred method to fabricate the looped fin of the present invention and helically affix it to a refrigerant carrying tube.

Referring to FIG. 1, the looped fin 3 of the present invention is fabricated in a unitary process combining several work stations which cooperate to produce and (if desired) to apply the looped fin 3 to a refrigerant tube 4. The basic steps in this method for making and applying the looped fin are: a coil 1 of fin stock 2, for example, aluminum of the 1100 alloy type, is horizontally oriented around a series of work stations arranged generally vertically on table 15 within the core of the coil 1, all of which rotate in the direction shown by arrow 16 around refrigerant tube 4 which is fed vertically at approximately the center of the coil 1 in the direction shown by arrow 5 (cf. U.S Pat. No. 3,134,166 to Venables). Any of several similar methods generally known in the art can also be used.

Figure 5:
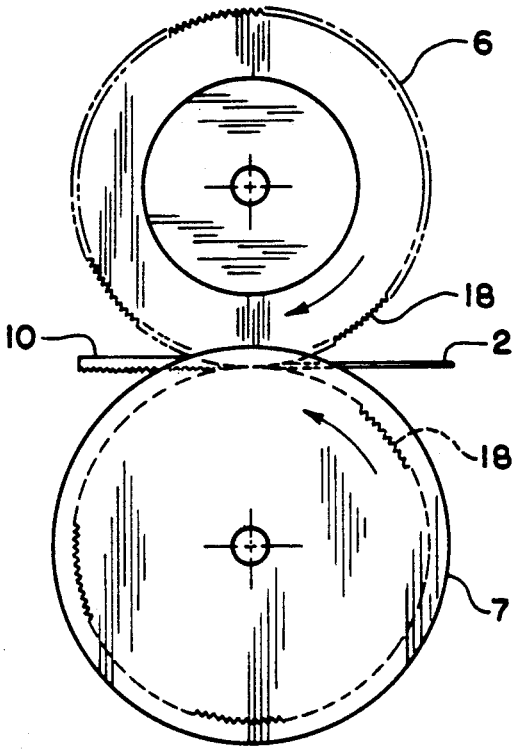
FIG. 5 is a plan view of the lance cutting work station.

Fin stock 2 is drawn from coil 1 by the cooperative rotation of the lance cutter rolls 6 and 7 which comprise work station A, which pulls the fin stock 2 therethrough. The equipment and processes for producing a series of slits through a moving belt of fin stock are generally known, and in this embodiment consist of two identical cutters 6 and 7 equipped with radial teeth 18 which intermesh as the cutters 6 and 7 operate on the fin stock 2 fed therebetween [shown in more detail in FIG. 5]. One of the lance cutters 7 is equipped with flanges of selected vertical dimension thereby making this one of the lance cutters 7 a "female" lance cutter and the other lance cutter 6, a "male" lance cutter.

Figure 6:
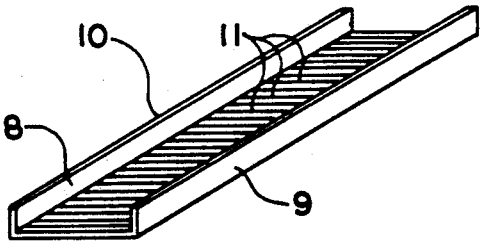
FIG. 6 is a perspective view of the lanced and channel-formed fin stock after it emerges from the lance cutting work station.

The width of the fin stock 2 is greater than the width of the lance cutters 6 and 7, so that when the male lance cutter 6 engages the fin stock 2 within the receiving chamber of female lance cutter formed by the flanges, the fin stock 2 is formed into a shallow lanced generally channel shaped form, with the unlanced portions, 8 and 9, of the fin stock extending perpendicularly [shown in more detail in FIG. 6]. When the fin stock 10 is reformed into its final shape 3, these unlanced base flange tips 8 and 9 become the mounting flanges (8 and 9, FIG. 9) which contact tube 4 in a heat transferring relationship. The center of the channel 10 is the lanced portion, with a series of slits 11 therein having been produced by the intermeshing teeth 18 of lance cutters 6 and 7.

The lanced and channelled fin stock 10 is then drawn into matched forming rolls 12 and 13 of selected dimension located at work station B. This station performs the function of stretch preforming and final U forming the lanced channel. As discussed in more detail below, stretch preforming renders the lanced channel 10 capable of being formed into a deep U-form in a single processing step. Stretch preforming provides a significant advance over the art, as heretofore, multiple forming steps were required to produce such a shaped heat transfer fin; see, e.g., U.S. Pat. No. 4,224,984, issued to Miyata, et. al.

Figure 7:
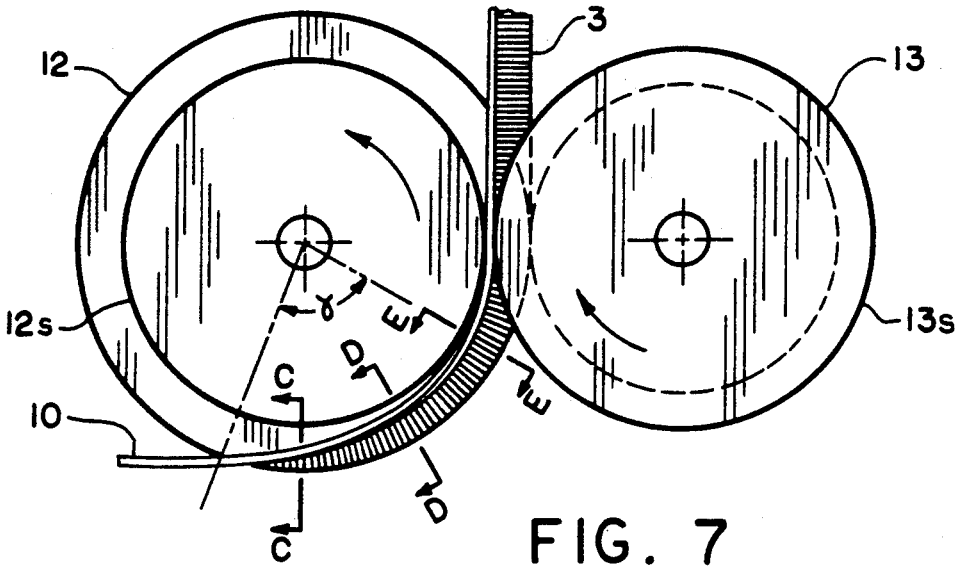
FIGS. 7 and 8 show in more detail how the lanced and channelled fin stock is progressively stretch formed around form roll 12 by the tension on the side flanges and formed into the final U-form at tangent contact between rolls 12 & 13.
Figure 7C:
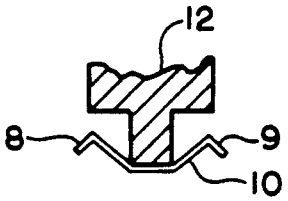
Figure 7D:
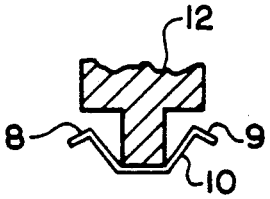
Figure 7E:
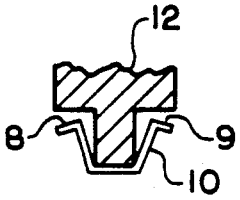
Figure 8:
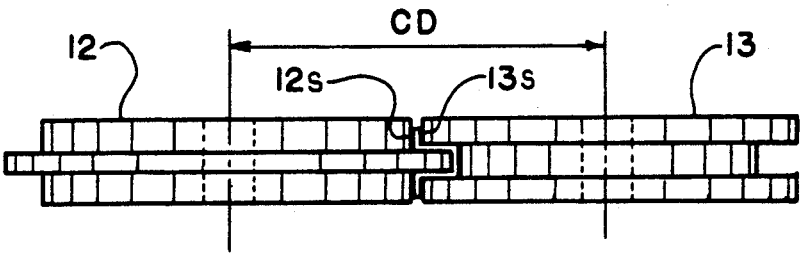

The center line through the axes of the form rolls 12 and 13 of work station B is oriented at an angle $\alpha$ in relation to the center line through the axes of lance cutters 6 and 7 of work station A, with the result that the lanced channel 10 is placed in tension as it is pulled around the male forming roll 12 before being pulled through the interface of forming rolls 12 and 13. Placing the form rolls 12 and 13 of work station B at a preselected angle in relation to work station A and operating these rolls at a slightly higher peripheral speed than the lance cutters 6 and 7 of station A puts tension on unlanced mounting flange tips 8 and 9 of the lanced channel 10 (FIG. 6, FIG. 7) between stations A and B. This tension begins to force the mounting flange tips 8 and 9 to move upwardly in a direction to be disposed parallel to the face of form roll 12, which causes the stock to stretch and begin to form a general U shape prior to the point of tangential contact with form roll 12. The stretch preforming function and U-forming sequence is discussed in more detail below and is shown in FIGS. 7 and 8.

As the general U-shaped fin stock emerges from work station B of FIG. 1, the product is now in its final configuration 3, an integrally formed chain comprising a pair of generally vertic leg members 10*a* and 10*b* connected by a bridge portion 10*c*, and having relatively short mounting flanges 8 and 9 substantially parallel to the bridge portion 10*c* extending perpendicularly from each vertical member 10*a* and 10*b* of the integrally formed chain 3, hereafter denominated as "looped fin." The integral chain of looped fins 3 may then be fed around work station C preparatory to being helically wound around the refrigerant tube 4 at work station D. At work station D, the integral chain of looped fins 3 may then be helically wound around the refrigerant tube 4 in an inverted fashion, the base flanges 8 and 9 of the looped fin being applied in contact with the outer periphery 4*a* of the tube 4 and the bridge portion of the looped fin 10*c* disposed generally circumferentially and outwardly in relation to the periphery 4*a*. Work station C is positioned at a selected angle $\beta$ in relation to work station D, and this angle $\beta$ permits the looped fin to approach the tube stock at the selected helix angle $\theta$. For example, $\theta$ is 19° when wrapping at a pitch of five fins (2½ looped fins) per inch, formed by the feed rate of refrigerant tube 4 along the line of direction represented by arrow 5, as the integrally formed chain of looped fins 3 is wrapped onto tube 4.

Figure 2:
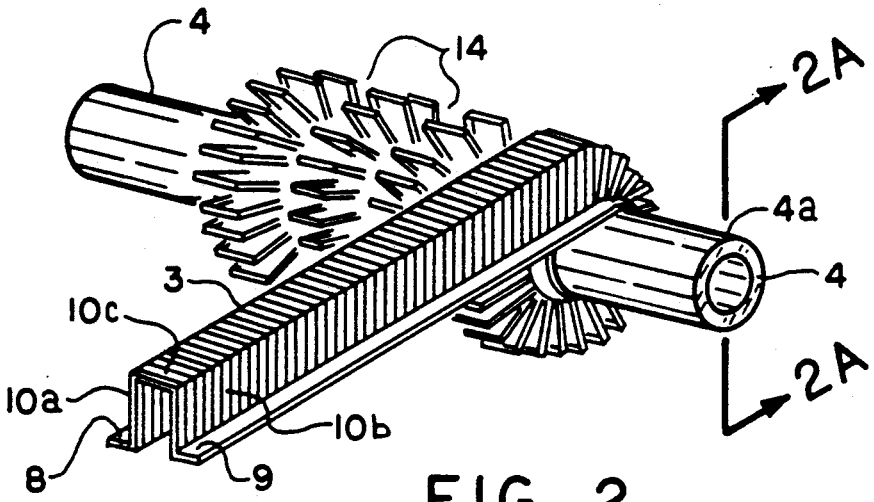
FIG. 2 is a perspective view of the looped fin of the present invention as it is helically affixed to a refrigerant carrying tube.
Figure 2A:
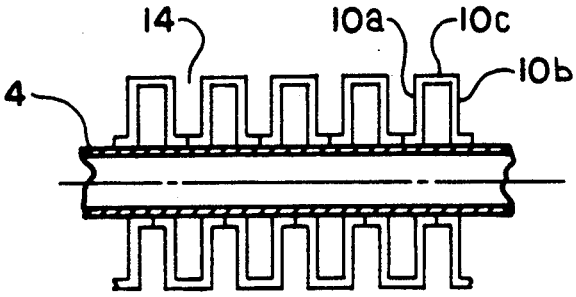
Figure 2B:
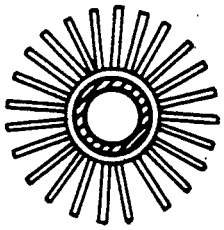

Referring now to FIGS. 2 and 3, in order to provide the most resistance to frost bridging, the looped fin 3 is helically wound around the refrigerant tube 4 at a preselected pitch or distance between rows. In this way the distance between members of the looped fin are spaced far enough apart in all three directions—from the mounting flange tips 8 and 9 of the fin to the bridge portion 10*c*, between the generally parallel vertical members 10*a* and 10*b* of the looped fin, and between helical wraps 14 of looped fins—to minimize frost bridging. For example, when 0.007" aluminum is used for the fin stock in one inch widths, lancing such stock 2 with slits 0.80" long and 0.030" wide 11 results in a generally shaped channel 0.800" across at its mid section (references 10 in FIG. 6) with unlanced mounting flange tips 8 and 9 generally perpendicularly disposed 0.100" each.. When such lanced channel is stretch preformed and worked into final looped fin configuration 3, the bridge portion 10*c* of the looped fin will be approximately 0.200" wide, vertical members 10A and 10B will be approximately 0.300" in length each, and the unlanced mounting flange tips 8 and 9 will be approximately 0.100" each in length. While the distance 14 between helical rows is generally controlled by the rotation of fin stock 2 and the rate of feed of tube stock 4, where mounting flange tips 8 and 9 are wound so as to be contiguous to each other, the distance between adjacent helical rows 14 will be nominally double the length of each connecting flange, or 0.200". These dimensions, which are exemplary only, have been found effective to prevent frost bridging while providing sufficient mechanical strength to permit pragmatic industrial use of the present invention.

Figure 15:
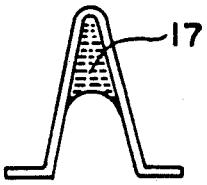
FIG. 15 shows how water is retained in V-shaped fins which do not provide certain advantages of this invention.

It is preferred that the fin members 10*a* and 10*b* as shown in FIG. 3 be essentially parallel to each other to provide optimum distance between fin members to minimize frost bridging. The bridge portion 10*c* of the invention, shown in FIG. 3, is optimum when it is essentially flat and substantially parallel to the mounting flange tips 8 and 9, but variations to this configuration can be tolerated with only slight degradation in performance as measured by resistance to frost bridging promotion and resistance to deformation during fabrication and application. For example, a slight radius 10*r* at the intersection of 10*a* and 10*b* as shown in FIG. 3A will have only slight effect in reducing resistance to frost bridging. Extending that radius to one half the distance between 10*a* and 10*b* to form an arch shaped bridge section 10*s*, as shown in FIG. 3B will also permit only slightly increased frost bridging. Generally semi-circled fin members (not shown) would also be effective in preventing frost bridging. When the looped fin is comprised of geometric shapes, such as shown in FIG. 3C and 3D, of a dimension approaching that of fin pitch spacing 14 the propensity to form frost bridging begins to increase. In addition, geometric shapes such as shown in FIGS. 3C and 3D offer less resistance to deformation. Decreasing the length of 10*c* as shown in FIG. 3C (also shown in FIG. 15) decreases the resistance to frost bridging, and when 10*c* is reduced to zero to form an inverted V-shape as shown in FIG. 15 (cf. U.S. Pat. No. 4,184,544 to Ullmer, Japanese Pat. Application 50-125,147, or Japanese Pat. Application 51-131,758), the vertex tips provide a nucleating site or focal point which promotes frost formation which in turn accelerates frost bridging. As may be seen in FIG. 15, these V-shapes can also hold defrost water by surface tension. The water is held in the form of a meniscus 17, which reduces effective fin surface as shown by the cross-hatched area of FIG. 15. The meniscus 17 shields the fin legs and bridge portion, and reduces the fin surface area available for effective heat transfer. The retained water also increases the amount of frost that forms on the fin in the next frost cycle and the rate at which frost builds up with repeated freeze-thaw cycles.

Figure 3A:
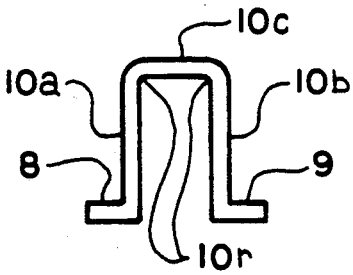
FIGS. 3A, 3B, 3C and 3D depict cross-sections of alternative configurations of the present invention.
Figure 3B:
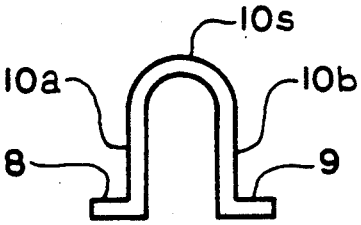
Figure 3C:
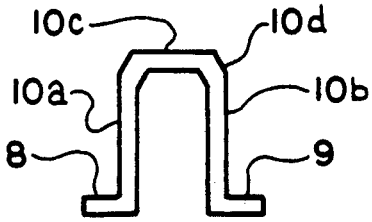
Figure 3D:
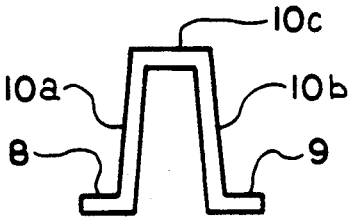
Figure 4:
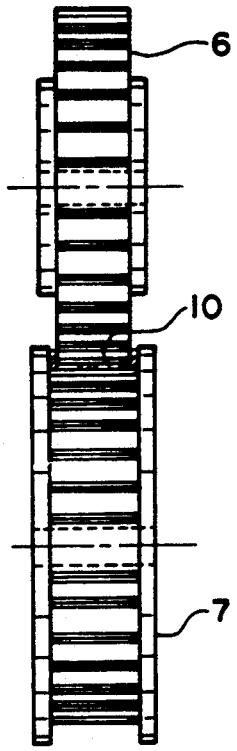
FIG. 4 is a side view of the lance cutting work station where fin stock is lanced and formed into a channel form.

To inhibit meniscus formation and frost buildup, for a straight flat bridge section 10*c* as shown in FIG. 3A, the bridge 10*c* should normally be at least about 0.12" long. Those skilled in the art can readily determine equivalent dimensions for other bridge configurations, using the teachings of this application, well-known principles of physics and frost formation, and simple experiments such as those set forth herein.

Stretch preforming and final U forming as accomplished at station B are shown in detail in FIGS. 7, 8, 14A and 14B. Stretch preforming is a novel process whereby the lanced channel 10 is progressively formed into an approximate U in a single forming step as the lanced channel 10 progresses around male roll 12 in its approach to the tangent point with female roll 13. Stretch preforming is accomplished by operating the work station B form rolls 12 and 13 at approximately 1% higher peripheral speed than the rate at which the lanced channel 10 is fed out of the lance cutters 6 and 7 at work station A. This places a tension upon the unlanced mounting flange tips 8 and 9 of the lanced channel 10. This tension acts to progressively bend the lanced center strips of lanced channel 10, shown in FIG. 7 at cross sections CC, DD and EE, into a sufficiently preformed U shape appropriate for entering the intermesh of form rolls 12 and 13 where the final U shape is produced at the point of tangency of form rolls 12 and 13. A center distance CD between form rolls 12 and 13 is selected which provides sufficient contact friction to mounting flange tips 8 and 9 to provide sufficient tension in preforming the U shape but to allow adequate slippage to prevent exceeding the elastic limit of the selected fin material.

An alternate method of providing adequate frictional drive while preventing exceeding the elastic limit of the selective fin material may be accomplished by spring loading the bearing support of either roll 12 or 13 to provide a floating or variable center distance CD to accommodate minor variations in the thickness of fin stock 2 and imperforate unlanced mounting flange tips 8 and 9. A second alternate to accomplish the same result can be provided by a slip clutch in the drive shaft of form rolls 12 and 13. Other methods generally known in the art could also be employed to provide the needed slippage of the generally U-shaped fin stock as it passes through form rolls 12 and 13.

FIG. 12 shows an alternate arrangement of Station B to provide final U forming after stretch preforming, in which form roll 13 is replaced by angular rolls 13*a*, 13*b*, and back up roll 13*c*.

Reference to FIG. 14A shows that, when $\alpha$ is approximately 90°, stretch preforming of the lanced channel is accomplished through an arc $\delta$ of the form 12, such that the original channel shaped fin stock emanating 10 from work station A is reformed into a subsequent U-shaped configuration 3, and that reformation, as shown in FIG. 7 (also in FIGS. 1 and 10) is substantially completed at point E—E, before the intermesh between male form roll 12 and female roll 13. Where $\alpha$ is approximately 90°, stretch preforming of the lanced channel 10 is accomplished through an arc $\delta$ of approximately 85° of form roll 12. Where proper tension is maintained on imperforate unlanced mounting flange tips 8 and 9, stretch preforming of lanced channel 10 commences at a leading angle $\omega$ (shown in FIG. 14A) prior to intersection of the lanced channel 10 with a line 20 through the axes of form roll 12 at CC which line 20 is parallel to a line 19 through the axes of lance cutters 6 and 7. By the time the lanced channel 10 has progressed around male form roll 12 to point C—C, the imperforate unlanced mounting flange tips 8 and 9 are already upwardly disposed as shown in Section C—C of FIG. 7. As the lanced channel 10 continues to be pulled around form roll 12, the imperforate unlanced mounting flange tips 8 and 9 become continuously more upwardly disposed, for example, as shown in Sections D—D and E—E, such that final forming of the lanced channel 10 may be accomplished by a single pass through the intermesh of rolls 12 and 13 to provide a subsequent configuration 3 comprising an integrally formed chain of U-shaped looped fins. In the preferred arrangement, as shown in FIG. 14A, when $\alpha$ is approximately 90°, stretch preforming occurs throughout an arc of $\delta$ of between 80° and 90°, preferably approximately 85°, and the corresponding leading angle $\omega$ is between 20° and 30°, with a preferred value of approximately 25°. FIG. 14B shows that $\alpha$ may range from 60° to 180°, as desired, to accommodate work stations in other arrangements besides those shown herein.

Figure 10:
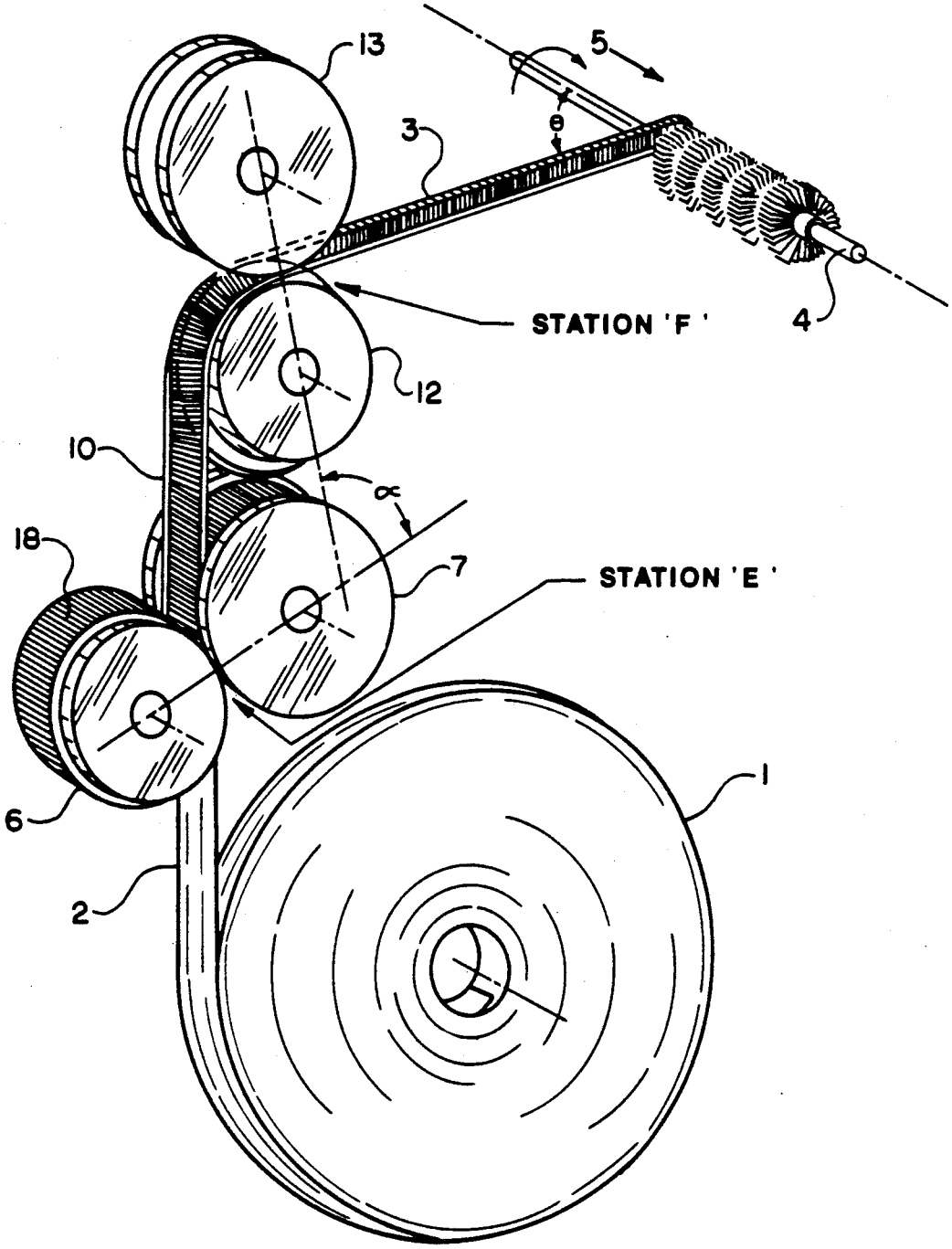
FIG. 10 is a perspective view of an alternative method of fabricating the looped fin and affixing it to a refrigerant tube.
Figure 11:
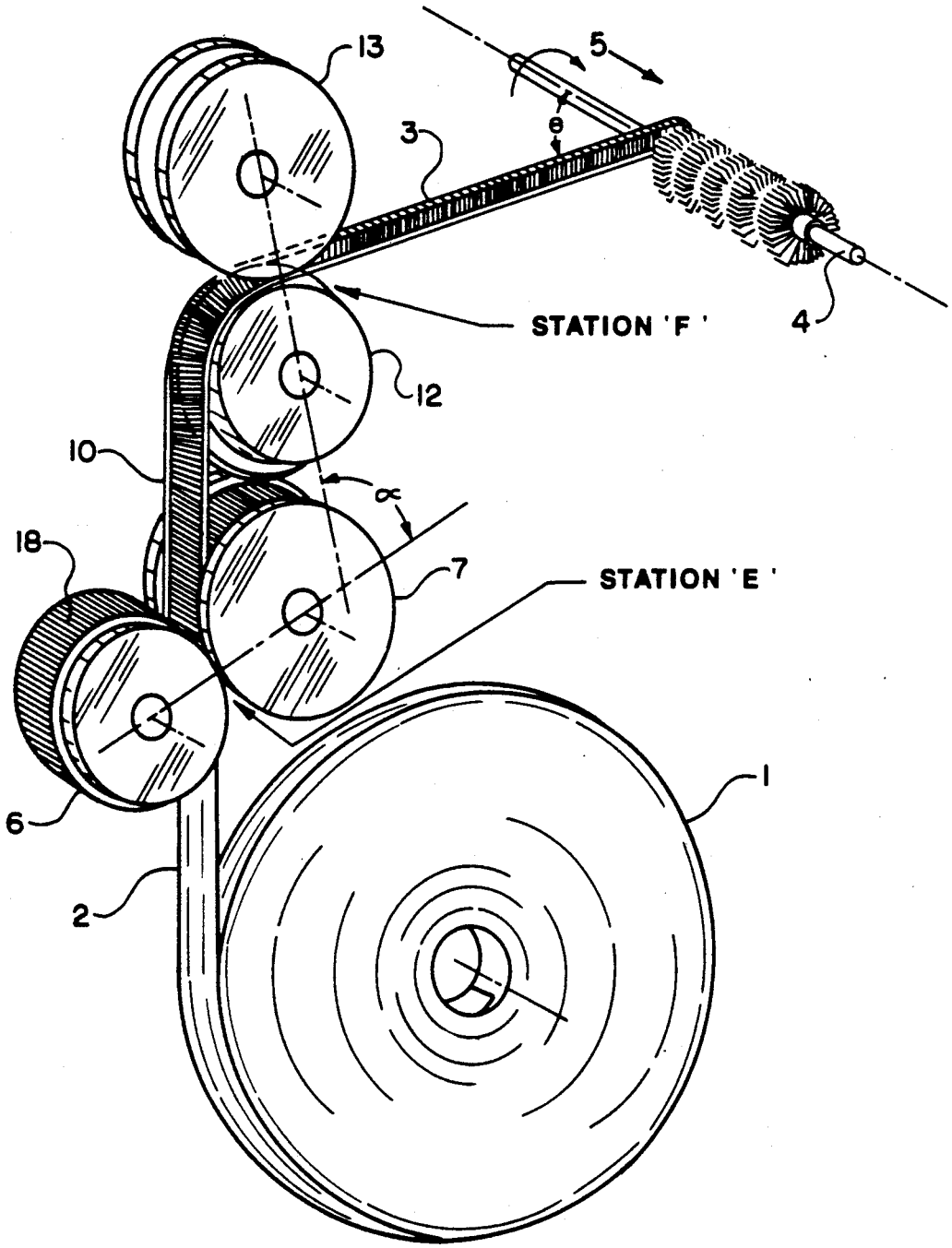
FIG. 11 is a perspective view of another alternative method of fabricating the looped fin and applying it to a refrigerant tube.

Alternative machinery arrangements for different methods of making the looped fin 3 of the present invention are disclosed in FIGS. 10 and 11. In FIG. 10, all rotational and directional motion is provided to the refrigerant tubing 4. In this method of making the looped fin 3, there are only two work stations, E and F, before the looped fin 3 is helically applied to the tubing 4. This provides more working or maintenance space between work stations. In FIG. 10, the helix approach angle $\theta$ with respect to the tubing 4 determined by the rotational and longitudinal feed rate of tube 4 is provided by appropriate angular placement of stations E and F with respect to the plane of travel of tubing 4. It would also be possible to maintain all axes of rotation in parallel orientation by adding an idler roll oriented to the helix angle such as is shown by station C on FIG. 1.

Another alternative method of making the loop fin of the present invention is shown in FIG. 11. In this embodiment, the lance station H performs only the lancing function and all final loop fin forming is performed at the forming station J. Lance Station H is similar to that described earlier in relation to FIG. 5 except that the flanges have been removed from lance cutter 7. Since the width of the fin stock 2 is greater than the width of the lance cutters 6 and 7, fin stock 2 emerges from lance station H as a flat center lanced strip 10*a* with imperforate portions 8*a* and 9*a* extending on each side of the slits 11 as shown in FIG. 13.

Figure 9:
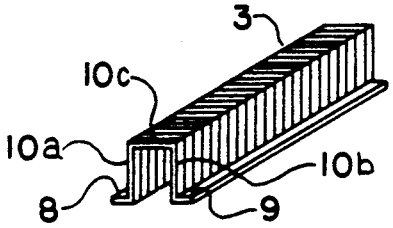
FIG. 9 is a perspective view of the looped fin after it emerges from the combined stretch-forming and U-forming work station.

Idler roll 20 at station I is located in such a manner as to guide the flat center lanced stock 10*a* and cause it to approach form roll 12 at an approach angle $\alpha$ prior to contact with form roll 12. As the flat center lanced stock 10*a* contacts form roll 12 it is stretch preformed around an arc $\delta$ of roll 12 until stretch preforming is complete prior to the intermesh between male roll 12 and female roll 13, where any remaining final U forming is accomplished, and the stock emerges in the loop fin configuration 3 as shown in FIG. 9, with 8*a* and 9*b* having become the mounting flanges of the looped fin 3.

In FIG. 11, it is seen that the machinery arrangement employing an idler roll 20 allows parallel alignment of the lance and form stations. Idler roll 20 aids in the critical step of stretch preforming in the process depicted in FIG. 11 by providing the adequate angle of approach of the center-lanced fin stock 10*a* to provide the tension on imperforate unlanced portions 8*a* and 9*a* required for stretch preforming. Similar to FIG. 1, the tension on imperforate unlanced portions 8*a* and 9*a* is provided by operating the cooperating forming rolls 12 and 13 of work station J at a slightly higher peripheral speed than the cooperating lance cutters 6 and 7 of work station H. For example, sufficient stretch preforming occurs if work station J is operated at a peripheral speed approximately 1% greater than work station H. After the center-lanced stock 10*a* has been routed over idler roll 20, stretch preforming and final U-forming are conducted at work station J. Work station J functions and operates essentially the same as work station B of FIG. 1 to provide the final looped fin configuration 3. After exiting from work station J the looped fin 3 may be wound onto the tubing 4 at work station K, with the helix angle $\theta$ controlled by the directional speed of the tube 4 along the line of arrow 5 and the rate of rotation of tube 4 as it travels along line 5, in a manner generally known.

In all methods of making the loop fin 3, as described in FIGS. 1, 10 and 11, appropriate wrapping tension is maintained in wrapping the looped fin 3 onto the tube 4 by adjusting the lance cutter drive to feed out approximately 1 to 3% less lanced fin stock length than is required to complete one helical wrap around the tube stock, or by utilizing a tension sensing device controlling a variable speed mechanism between the tube rotating and the lance cutter drives. The wrapping tension provides good contact between mounting flanges 8 and 9 and tube 4, which helps attain good heat transfer.

Stretch wrapping also provides superior ability to withstand the freeze-thaw cycles to which refrigerator evaporators and similar cyclically frosted heat exchangers are subjected. When these exchangers are defrosted, water can enter any crack or crevice between the tube and the fins. When the heat exchangers are once again cooled below the freezing point, the water freezes, and expands. The repeated expansion and admission of additional water that occurs in these freeze-thaw cycles may wreck rigid attachments such as braze or solder joints, screwed or bolted connections or the like in short order. However, when a chain of fins is stretched around a tube so that the mounting flanges can stretch further to accommodate the slight expansion that may occur in any one frost cycle without exceeding their elastic limits, the tension in the flanges causes them to retract during the next defrost cycle, thereby maintaining the original mechanical integrity.

The looped fin heat transfer devices of this invention are superior to conventional heat exchangers in many other ways, particularly in cyclical frosting environments such as household refrigerators, as may be seen from the following examples.

EXAMPLE I

Calorimeter tests were conducted to compare the heat exchange capacity of dry looped fin heat exchangers with conventional plate fin evaporators for two different makes of currently available frost-free refrigerators. One of the plate fin evaporators, for an 18 cubic foot top mounted refrigerator, i.e. a refrigerator with a freezer compartment above the fresh-food compartment, had two rows of tubes ⅜ of an inch in diameter. Each tube pass was 21 inches long. The tube passes were connected by return bends to form a serpentine heat exchanger. Plate fins, 2" wide by 8" long, were mounted across the tube bundles at right angles to the tubes, spaced 5 fins to the inch.

The second plate film evaporator, for a 16 cubic foot top mounted refrigerator of a different manufacturer, had two rows of 7 tubes, ⅜ of an inch in diameter by 17 inches long. Again the tubes were joined in a serpentine pattern by return bends, with plate fins across the tubes at right angles. The plates of this evaporator were spaced 4 fins to the inch and the individual plates measured 2.25" by 7".

The looped fin evaporators were produced by winding lanced and formed strips onto ⅜" tubing and bending the finned tubing to form a single layer of serpentine passes 19.5 inches long. The overall dimensions, fin spacing, fin surface areas and evaporators weights for both the looped fin and plate fin evaporators are set forth in Table 1.

TABLE IA

| Evaporator | Dimensions (inches) | Fin Spacing (Fins per inch) | Fin Area ($in^2$) | Coil Weight (lbs) |
|---|---|---|---|---|
| A - Plate Fin | 21 × 8 × 2 | 5 | 3392 | 2.49 |
| B - Plate Fin | 17 × 7 × 2.25 | 4 | 2110 | 2.09 |
| C - Looped Fin | 19.5 × 8 × 1 | 5 | 1130 | 1.03 |
| D - Looped Fin | 19.5 × 8 × 1 | 6 | 1356 | 1.09 |
| E - Looped Fin | 19.5 × 8 × 1 | 7 | 1582 | 1.12 |
| F - Looped Fin | 19.5 × 8 × 1 | 8 | 1808 | 1.25 |

The evaporators were tested under identical frosting conditions, one at a time, in an plenum inside a calorimeter maintained at a controlled temperature of 0° F. The plenum, a vertically oriented channel with a rectangular cross-section and openings for admitting and discharging air at the bottom and top respectively, was designed to simulate the chambers within which conventional plate film evaporators are mounted in commercially available frost-free refrigerators. Air was circulated across the outsides of the evaporators by a fan and a centrifugal blower operating in series. Refrigerant was circulated through the tubes by a variable flow controlled condensing unit. Air flow and refrigerant flow were measured, by a measuring orifice and a measuring rotameter respectively, and the flow rates were adjusted to achieved balanced conditions across the evaporators. Moisture was added to the recirculating air by a humidifier in the air stream leading to the plenum to establish a desired quantity of frost on the coil under test. During the test, heat was added by a heater controlled by a rheostat. Heat transfer rates were determined by measuring the wattage supplied to the heaters which just balanced the heat absorbed by the test evaporator.

Figure 16:
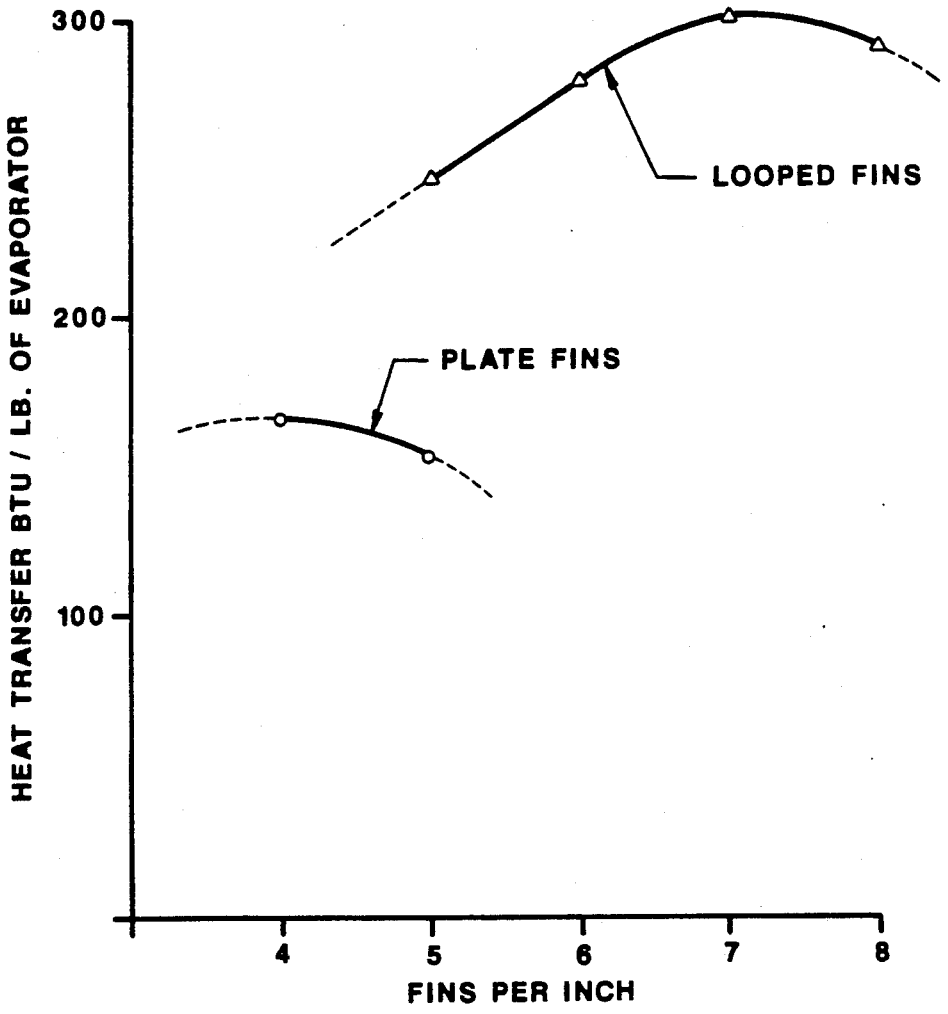
FIG. 16 is a graph of specific heat exchange capacity, i.e. heat transfer per pound, for looped fin and plate fin refrigerant evaporators with various fin spacings.

Performance date for the evaporators is set forth below in Table IB, and in FIG. 16. The specific heat exchange capacities of the looped fin evaporators were dramatically higher than the capacities of the plate fin evaporators. This is due in large measure to the much smaller, more efficient fins. They have a much higher ratio of surface area to weight. Also, they do not generate boundary layers as plates do (cf the Chuang paper noted above). Instead, they break up the streams of air to induce turbulent flow, which helps increase the film heat transfer coefficient—typically the limiting factor in heat exchangers of this type.

TABLE IB

| Evaporator | Fin Spacing (Fins per inch) | Capacity (BTUs) | Specific Capacity (BTU/LB) |
|---|---|---|---|
| A - Plate Fin | 5 | 380 | 153 |
| B - Plate Fin | 4 | 350 | 167 |
| C - Looped Fin | 5 | 255 | 248 |
| D - Looped Fin | 6 | 305 | 280 |
| E - Looped Fin | 7 | 335 | 299 |
| F - Looped Fin | 8 | 365 | 292 |

With the fan, plenum and evaporator parameters of this test, a looped fin evaporator with 7 fins per inch of tubing length provided the best specific heat exchange capacity. The optimum may vary from application to application, depending upon system parameters, but will generally be somewhere between about 5 fins per inch and about 8 fins per inch. Those skilled in the heat exchange art can easily determine the optimum configuration for any given application, using well known heat exchange principles and/or simple tests such as those described herein.

EXAMPLE II

The energy efficiency of looped fin and plate fin evaporators was compared by mounting the evaporators in a 26 cubic foot frost-free side-by-side refrigerator (with the freezer compartment beside the fresh-food compartment) placed in an environmental chamber at a controlled temperature of 90° F., and measuring the power required to achieve a certain temperature in the freezer compartment at the end of a 12-hour period. For each run, the refrigerator controls were set to achieve progressively colder temperatures, checked by thermocouples within the refrigerator. At the start of each run, the refrigerator was soaked for 18 hours to allow it to stabilize at 90° F. Following stabilization, the refrigerator was operated for 12 hours and energy consumption was measured. Two looped fin evaporators and one plate fin evaporator was used.

Figure 17:
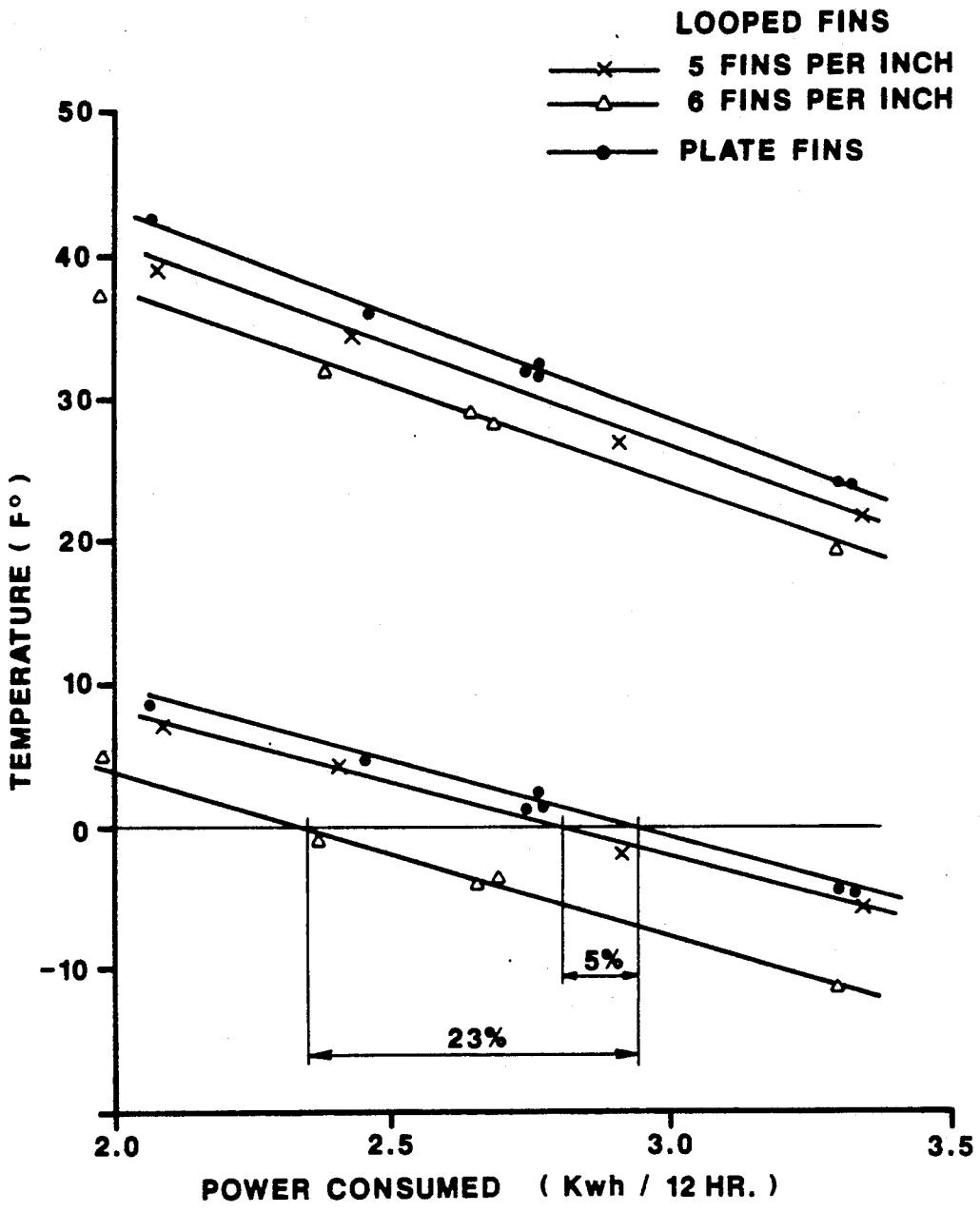
FIG. 17 is a graph of tests in a commercially available refrigerator, comparing energy efficiency for two looped fin evaporators with the plate fin evaporator designed for this refrigerator.

The results are shown in FIG. 17. With the 6 fin per inch looped fin evaporator, 2.35 Kwh were required to maintain a freezer temperature of 0° F. That is 23% less than the 2.94 Kwh required with the plate fin evaporator specifically designed for this refrigerator. Even the 5 fin per inch looped fin evaporator, with 46% less surface area than the plate fin, required 5% less power. With the increasing pressure for appliance efficiency, the significance of this saving is clear.

EXAMPLE III

The ability of a refrigerator evaporator to continue to provide cold freezer temperatures when inhibited by frost build-up is most important to the manufacturer. A "frost tolerance" test was designed to make accurate comparisons between different frosted evaporators mounted in the same refrigerator cabinet.

To do this, the test refrigerator was placed in the environmental room controlling at 90 degrees F. The standard thermostat was bypassed so that the compressor would run without cycling (100% run). A pan of water, heated by an electric heater, was placed in the fresh-food compartment and the heater connected to an external variable transformer. In this way, the heat load could be altered to evaporate more or less water. As the fan in the refrigerator circulated the air, moisture in the air was precipitated onto the evaporator, thus simulating what happens to an evaporator when a refrigerator is operated in humid conditions.

Figure 18:
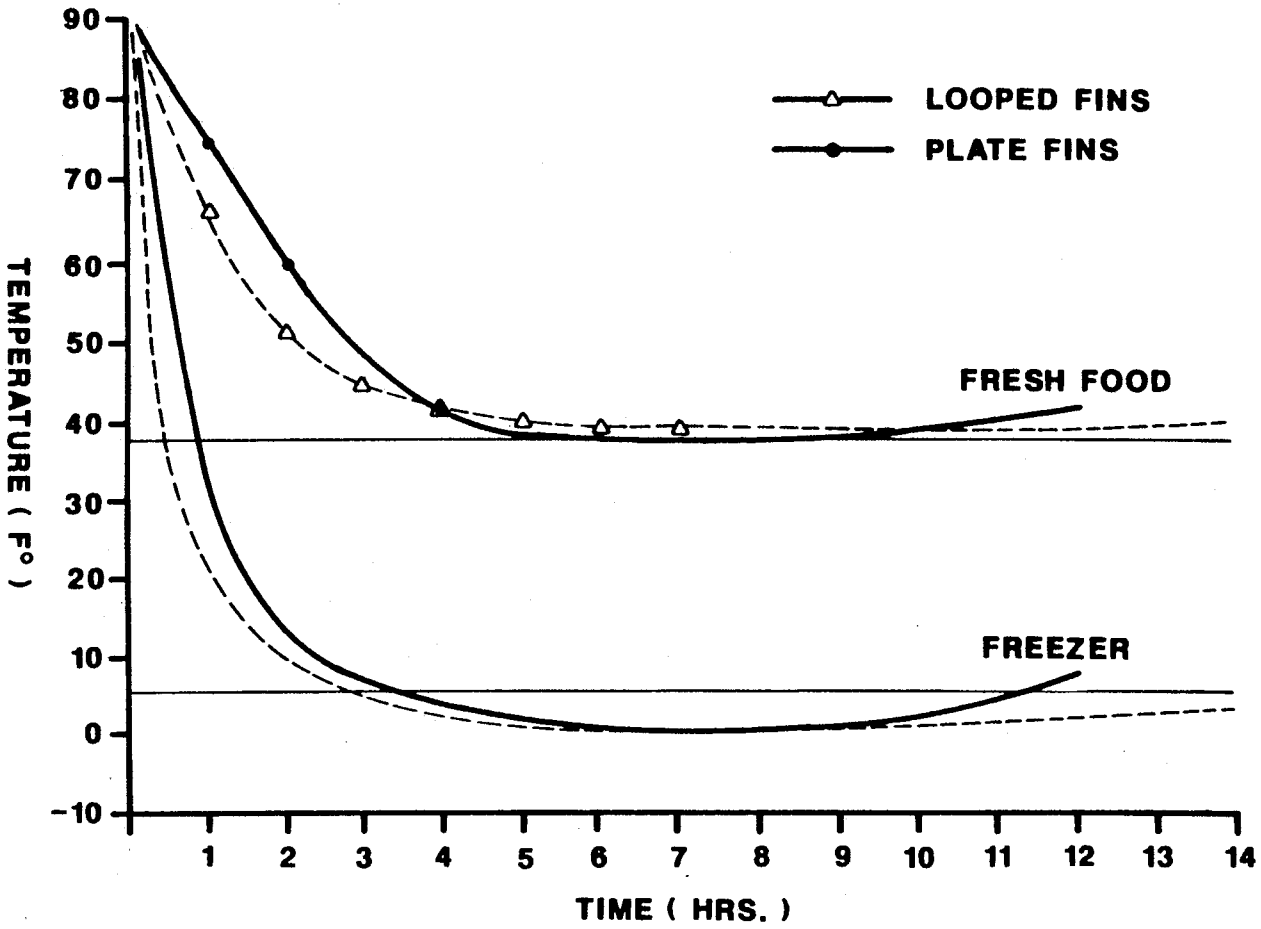
FIG. 18 illustrates the superior frost tolerance of the looped fin evaporators of this invention installed in commercially available refrigerators, as compared to the plate fin coil normally provided with one refrigerator and the extruded and lanced fin coil normally provided with another.

For each particular refrigerator, it was necessary to alter the variable transformer setting so that temperatures in the refrigerator would reach desired low values after 4–6 hour pull down and so that sufficient frost would accumulate on the evaporator surfaces so that heat transfer efficiency would deteriorate by a measured amount. Once the variable transformer setting was found for that refrigerator, the standard evaporator was removed, replaced with a looped fin evaporator and the test repeated with all variables controlled to the same values. FIG. 18 shows a typical result from tests on an 18 cubic foot refrigerator. Both looped fin and plate fin evaporators pulled the freezer from 90 degrees F. to 0 degrees F. in 7 hours, but frost on the plate fin evaporator caused the freezer temperature to rise to 5 degrees F. (the upper acceptable limit) by the 11th hour, necessitating that this coil be defrosted. The looped fin evaporator was still below 5 degrees at 14 hours, in fact did not require defrosting until 16 hours (off edge of graph).

EXAMPLE IV

Pull down tests, commonly used by refrigerator manufacturers to test evaporators, were conducted with different types of evaporators. One was a conventional extruded and lanced fin evaporator, designed for and sold with the 24 cubic foot side-by-side refrigerator in which these tests were conducted. These fins are produced by extruding a tube, typically, as in this instance, 0.5 inches in diameter, with flanges 1.25 inch wide on each side of the tube. The flanges are lanced to form transversely extending strips, which are twisted so that the flat sides of the fins (or lanced strips) are at an angle to the axis of the tubing. The extruded tubing is then bent into a serpentine configuration, with the fins extending longitudinally at approximately a right angle to the plane of the serpentine tubing. In the evaporator of this test, the fins were 0.22 inches wide, 1.25 inches long, and twisted to an angle of about 90° with the tubing axis. This yields a fin spacing of about 4½ fins per inch in the finished evaporator, and a fin area of 1975 square inches.

The second evaporator had looped fins with a substantially square . cross-sectional configuration (as in FIG. 3A), 0.336" high×0.167" wide, wound at 6 fins per inch on a ⅜" tube. The tube was bent to form 27 coplanar serpentine passes, each 9.625" long overall. Total fin surface area was 1780 square inches.

To demonstrate the importance of bridge 10*c*, a third evaporator was produced by winding another lanced and formed strip on ⅜" tubing. This evaporator was identical to the looped fins evaporator described above. except that the fins were in a form of a "V" (as shown in FIG. 16). The sides of these fins were 0.40" long, and the base of the V was 0.2" wide, making the resulting triangle 0.39" high.

The evaporators were mounted, one at a time, in a 24 cubic foot side-by-side refrigerator (for which the extruded and lanced evaporator was designed). The refrigerator was allowed to stand (or soak) in a controlled environmental room, held at 90° F., for 18 hours. The test procedure was as used in the frost tolerance test in Example III. During the test, 24.5 watts were supplied to a heater in a flat water pan within the refrigerator, thereby evaporating 200 ml of water onto each evaporator during its 12 hour test. This simulates the moisture introduced into a refrigerator when the refrigerator door is opened repeatedly, as in commonly used refrigerator tests.

Figure 19:
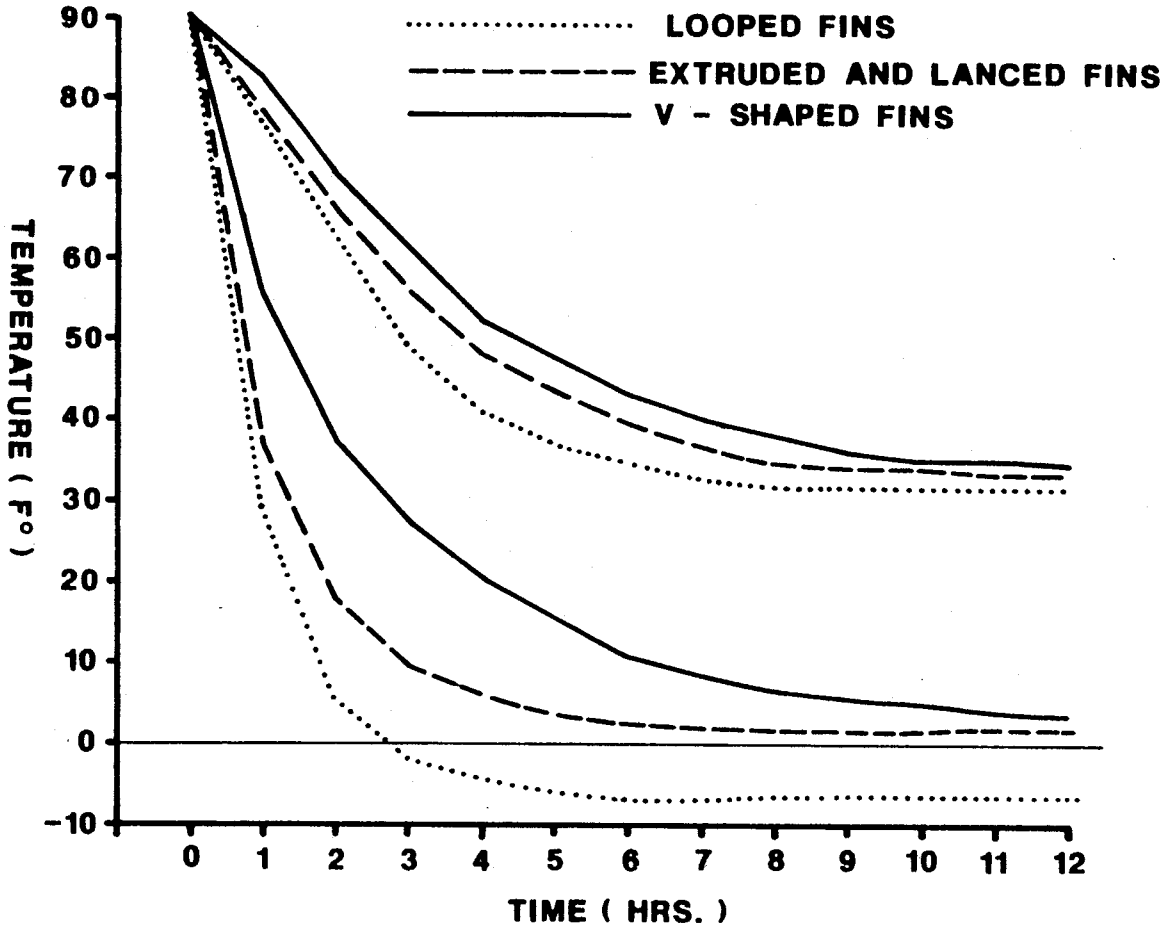
FIG. 19 is another graph of the performance of different evaporators—one with a looped fin coil, another with a conventional extruded and lanced fin coil and a third with a coil that simulates the V-shaped heat exchange structures shown in U.S. Pat. No. 4,184,544 to Ullmer, Japanese Patent Application 50-125,147 and Japanese Patent Application 51-131,758.

The results are shown in FIG. 19. The looped fin evaporators (dotted line) was clearly superior to the extruded fin evaporator (darkened line). On the other hand, the evaporator with V-shaped fins was clearly inferior to both the looped fin evaporator and the extruded fin evaporator. The conclusion is clear: the inferior performance must be due to the sharp apices of the V-shaped fins and the frost build-up they engender.

These tests leave no doubt of the superiority of the looped fin evaporators of this invention; they have higher specific heat capacities than conventional plate film heat exchangers; and they are more energy efficient. They also tolerate frost better than conventional plate fin evaporators, conventional extruded and lanced fin evaporators, and the V-shaped structures of U.S. Pat. No. 4,184,544 and Japanese Patent Applications 50-125,147 and 51-131,758.

Those skilled in the art will readily appreciate that the advantages provided by these looped fin heat exchangers can be achieved in a variety of configurations that differ from those depicted an described herein. The specific examples of this application are merely illustrative. They should not be used to limit the scope of this invention, which is defined by the following claims.

I claim:

1. A method of making a looped fin heat transfer device comprising the steps of:

[a] providing an elongate ribbon of thermally conductive material;

[b] transversely lancing and forming said ribbon into an intermediate configuration having a pair of imperforate opposing side portions interconnected by a lanced web portion; and

[c] stretching said imperforate side portions of said intermediate configuration to reform the same into a subsequent configuration comprising an integrally formed chain of looped fins, said chain comprising an integrally formed chain of looped fins, said chain comprising a mounting flange reformed from each of said imperforate opposing side portions at each edge of said chain and a plurality of fins between said mounting flanges, each of said fins comprising leg members extending outwardly from each of said mounting flanges and a bridge section connecting said leg members at the distal end of said leg members.

2. A method according to claim 1 wherein said intermediate configuration comprises a shallow generally channeled cross section.

3. A method according to claim 2 wherein said lanced web portion is reformed from said intermediate configuration said subsequent configuration by stretch preforming said intermediate configuration by pulling said ribbon around a male forming roll adapted to initially contact the center of said lanced web portion, whereby tension on the imperforate side portions and the pressure of the forming roll on the center of said web portion gradually reforms said web portion to conform to said male forming roll.

4. A method according to claim 3 wherein said stretch preforming occurs as center of said lanced web portion contacts said male forming roll through an arc between 80° and 90°.

5. A method according to claim 4 wherein said arc is 85°.

6. A method according to claim 3 wherein said male forming roll comprises a central forming section and a shoulder on each side of said central forming section, and said ribbon is pulled around said male forming roll by said shoulders and complementary shoulders on a female forming roll.

7. A method according to claim 6 wherein the shoulders of said rolls grip the imperforate side portions of said ribbon.

8. Apparatus for making a looped fin heat transfer device, comprising, in combination:

[a] means for supplying an elongate ribbon of thermally conductive material;

[b] means for transversely lancing said ribbon into an intermediate configuration having a pair of imperforate opposing side portions interconnected by a lanced web portion; and

[c] means for stretching and reforming said intermediate configuration into a subsequent configuration comprising an integrally formed chain of looped fins, said chain having a mounting flange reformed from each of said imperforate opposing side portions at each base edge of said chain and a plurality of fins extending between said mounting flanges with each of said fins comprising vertical leg members extending outwardly from each of said mounting flanges and a bridge portion connecting said leg members at the distal end of said leg member.

9. The invention of claim 8 wherein said means for supplying said elongate ribbon comprise coil holding means connectable to said means for transversely lancing and forming said ribbon into said intermediate configuration.

10. The invention of claim 9 wherein said means for transversely lancing said ribbon into said intermediate configuration comprise a pair of opposing lance cutter means disposed to receive said ribbon therebetween.

11. The invention of claim 10 wherein one of said lance cutters is provided with forming means comprising vertical extensions at the opposite ends of its cutting surface to simultaneously lance said ribbon and reform the same to produce said intermediate configuration having a shallow generally channeled cross section.

12. The invention of claim 10 wherein said means for stretching and reforming said generally channeled intermediate configuration into said subsequent configuration comprising an integrally formed chain of looped fins comprise a pair of form rolls disposed at a preselected angle to said lance cutter means to receive said intermediate configuration therebetween and stretch and reform said intermediate configuration into said subsequent configuration comprising an integrally formed chain of looped fins, said chain having a mounting flange at each base edge of said chain and a plurality of fins extending between said mounting flanges with each of said fins comprising leg members extending outwardly from each of said mounting flanges and a bridge portion connecting said leg members at the distal end of said leg members.

* * * * *